US007854360B2

(12) United States Patent
Suda

(10) Patent No.: US 7,854,360 B2
(45) Date of Patent: Dec. 21, 2010

(54) DRIVING POWER TOOL HAVING A CONTROL CIRCUIT

(75) Inventor: Hidekazu Suda, Anjo (JP)

(73) Assignee: Makita Corporation, Anjo-shi (JP)

( * ) Notice: Subject to any disclaimer, the term of this patent is extended or adjusted under 35 U.S.C. 154(b) by 228 days.

(21) Appl. No.: 12/081,295

(22) Filed: Apr. 14, 2008

(65) Prior Publication Data

US 2008/0251558 A1 Oct. 16, 2008

(30) Foreign Application Priority Data

Apr. 12, 2007 (JP) ..... 2007-105345

(51) Int. Cl.
*B25C 1/18* (2006.01)

(52) U.S. Cl. ..... 227/2; 227/10; 227/5; 227/8

(58) Field of Classification Search ..... 227/2, 227/5, 7, 8, 10
See application file for complete search history.

(56) References Cited

U.S. PATENT DOCUMENTS 3,574,918 A * 4/1971 Focht ..... 29/243.54
3,657,964 A * 4/1972 Workman et al. ..... 91/1
3,661,312 A * 5/1972 Pomernacki ..... 227/8
3,786,978 A * 1/1974 Manganaro ..... 227/8
3,888,404 A * 6/1975 Ramspeck et al. ..... 227/8
4,300,282 A * 11/1981 Bunyea et al. ..... 29/751
4,500,938 A * 2/1985 Dulin ..... 361/153
4,573,624 A * 3/1986 Muller et al. ..... 227/121
4,679,719 A * 7/1987 Kramer ..... 227/5
4,694,984 A * 9/1987 Altwicker ..... 227/18
5,012,967 A * 5/1991 Johansson ..... 227/7
5,357,179 A * 10/1994 Abbagnaro et al. ..... 318/17
5,406,441 A * 4/1995 Warda et al. ..... 361/179
5,447,131 A * 9/1995 Nickel et al. ..... 123/335
5,752,643 A * 5/1998 MacVicar et al. ..... 227/10
5,918,788 A * 7/1999 Moorman et al. ..... 227/8
5,957,213 A * 9/1999 Loraas et al. ..... 172/2
6,123,241 A * 9/2000 Walter et al. ..... 227/8
6,311,887 B1 * 11/2001 Walter ..... 227/10

(Continued)

FOREIGN PATENT DOCUMENTS

JP A 2004-74298 3/2004

OTHER PUBLICATIONS

May 31, 2010 European Search Report in European Application No. 08007222.6.

*Primary Examiner*—Brian D Nash
(74) *Attorney, Agent, or Firm*—Oliff & Berridge, PLC

(57) ABSTRACT

It is an object of the invention to provide a technique for preventing power tool from being operated by a malfunction of the control circuit. A representative driving power tool includes a movable element, a drive unit to drive the movable element, an actuation circuit to actuate the drive unit, a control circuit and an operation switch that outputs an operation signal. The control circuit outputs a control signal when the operation signal for instructing driving of the movable element is outputted from the operation switch. The actuation circuit actuates the drive unit when the control signal is outputted from the control circuit. Actuation of the drive unit is blocked when the control signal outputted from the control circuit is abnormal. According to the invention, a movable element can be prevented from being moved by malfunctioning of the control circuit.

11 Claims, 10 Drawing Sheets

U.S. PATENT DOCUMENTS 6,431,425 B1 * 8/2002 Moorman et al. ..... 227/8
6,705,503 B1 * 3/2004 Pedicini et al. ..... 227/131
2002/0185514 A1 * 12/2002 Adams et al. ..... 227/2
2004/0182336 A1 * 9/2004 Ohmori et al. ..... 123/46 R
2005/0029323 A1 * 2/2005 Shima et al. ..... 227/10
2008/0011251 A1 * 1/2008 Tanaka ..... 123/46 SC
2008/0017689 A1 * 1/2008 Simonelli et al. ..... 227/132

* cited by examiner

DRIVING POWER TOOL HAVING A CONTROL CIRCUIT

BACKGROUND OF THE INVENTION

1. Field of the Invention

The present invention relates to a technique for preventing a power tool for performing an operation on a workpiece from malfunctioning.

2. Description of the Related Art

Japanese non-examined laid-open Patent Publication No. 2004-74298A discloses a known combustion driving power tool with a safety switch for preventing malfunctioning. According to the known tool, a control circuit executes injection of flammable gas into a combustion chamber when a push lever is pressed against the workpiece and a head switch is turned on. Thereafter, when a trigger switch is turned on, the control circuit actuates an ignition circuit to burn the flammable gas. Then, a driver blade 16 is moved by pressure generated by combustion of the flammable gas so that the nail is driven into the workpiece. The safety switch is provided between a battery and the control circuit and the control circuit is not energized when the safety switch is not on. Thus, the driving operation is blocked when the safety switch is off. On the other hand, the control circuit is defined by a microcomputer and may cause malfunctioning. For example, when the trigger switch is not on, a driving control signal may be outputted form the control circuit.

SUMMARY OF THE INVENTION

Accordingly, it is an object of the invention to provide a technique for preventing power tool from being operated by a malfunction of the control circuit.

Above-mentioned object can be achieved by a claimed invention. A representative driving power tool according to the invention includes a movable element, a drive unit that drives the movable element, an actuation circuit that actuates the drive unit, a control circuit and an operation switch. The movable element can move a material to be driven in a driving direction. The material to be driven is moved in a driving direction by the movable element, so that the driving operation is performed. The drive unit generates a driving force for moving the movable element. As this drive unit, various kinds of drive units with which driving operation can be performed by movement of the movable element can be used. Typically used are a drive unit utilizing the combustion force of flammable gas, a drive unit utilizing the driving force of a motor, and a drive unit utilizing the compression force of a compressed medium. The actuation circuit is selected according to the drive unit. For example, an ignition circuit is used for the drive unit utilizing the combustion force of flammable gas, and a motor drive unit is used for the drive unit utilizing the driving force of a motor. The operation switch outputs an operation signal for instructing driving of the movable element. As the operation switch, for example, a switch in which a moving contact is in contact with a fixed contact during operation is used. The control circuit is formed by a microcomputer and outputs a control signal to the actuation circuit based on the operation signal outputted from the operation switch. The actuation circuit actuates the drive unit based on the control signal outputted from the control circuit.

In this invention, actuation of the drive unit for driving the movable element is blocked when the control signal outputted from the control circuit is abnormal. Various methods can be used as a method of determining that the control signal outputted from the control circuit is abnormal. From the viewpoint of ease of the determining process, however, it is preferable to use a method of determining that the control signal was outputted from the control circuit in abnormal condition. As the method of determining that the control signal was outputted from the control circuit in abnormal condition, for example, a determining method using a discriminant reference signal which can be used to determine that the control circuit is in abnormal condition, or a discriminant reference signal which can be used in combination with the control signal to determine that the control circuit is in abnormal condition can be applied. Various methods can be used as the method of blocking actuation of the actuation circuit when the control signal is abnormal. For example, a method in which the actuation circuit stops actuation of the drive unit when the control signal outputted from the control circuit is abnormal, or a method of blocking input of the control signal into the actuation circuit when the control circuit is abnormal.

In this invention, actuation of the drive unit for driving the movable element is blocked when the control signal outputted from the control circuit is abnormal. As a result, the movable element can be prevented from being moved by malfunctioning of the control circuit.

In another aspect of the invention, a block circuit may preferably be provided between the control circuit and the actuation circuit for actuating the drive unit in order to block actuation of the drive unit when the control signal is abnormal. The block circuit blocks passage of the control signal when the control signal is abnormal. As the block circuit, typically, a circuit for executing AND logical operation of the control signal and one or more discriminant reference signals. The AND logical operation may be executed in either a hardware or a software. Further, the AND logical operation of the control signal and discriminant reference signals includes various equivalent logical operations.

In this aspect, it is essential for the invention that the block circuit is provided between the control circuit and the actuation circuit. Thus, it is not necessary to change or modify the control circuit or the actuation circuit. Therefore, the movable element can be prevented from being moved by malfunctioning of the control circuit, while using the existing control circuit and actuation circuit.

Following methods can be alternatively and selectively used as the method for determining that a control signal was outputted from the control circuit in abnormal condition.

(First Discrimination Method)

The control circuit outputs a control signal for controlling the actuation circuit when an operation signal for instructing driving of the movable element is outputted from the operation switch. Therefore, if a control signal was outputted from the control circuit in the state in which the operation signal for instructing driving of the movable element was not outputted from the operation switch, there is a possibility that the control signal was outputted from the control circuit in abnormal condition.

Therefore, in the first discrimination method, when a control signal was outputted from the control circuit in the state in which the operation signal for instructing driving of the movable element was not outputted from the operation switch, it is determined that a control signal was outputted from the control circuit in abnormal condition.

In the first discrimination method, a signal for indicating that the operation signal for instructing driving of the movable element has been outputted can be used as a first discriminant reference signal. In this case, the block circuit for blocking the control signal by using the first discrimination method can be formed, for example, by a circuit for executing AND logical operation of the first discriminant reference signal and the control signal.

In the first discrimination method, by using the operation signal for instructing driving of the movable element in association with the output of the control signal from the control circuit, it can be readily determined that the control signal was outputted from the control circuit in abnormal condition.

(Second Discrimination Method)

The control circuit executes a reset process at power-on. Generally, the control circuit hardly executes a reset process during operation (when the power is on). Therefore, if the control circuit executes a reset process during operation, there is a possibility that the control circuit is in abnormal condition.

Therefore, in the second discrimination method, when the control circuit executed a reset process during operation, it is determined that a control signal was outputted from the control circuit in abnormal condition. In this respect, it is necessary to distinguish whether a reset process has been executed at power-on or during operation. To this end, in the second discrimination method, when a control signal was outputted from the control circuit within a specified time period after the control circuit completed execution of a reset process, it is determined that the control signal was outputted from the control circuit in abnormal condition. As this specified time period, for example, a time period which is shorter than the time period from the instant when the power is turned on to the instant when the operation signal for instructing driving of the movable element is first outputted from the operation switch is selected.

Based on the state of an arbitrary terminal of the control circuit, it can be determined that the control circuit has completed execution of the reset process. For example, one of the terminals of the control circuit is selected which is placed in the input state during execution of the reset process (in the resetting state) and to which a signal of level "L" is outputted when the execution of the reset process is completed (in the reset released state). A power source is connected to this terminal via a pull-up resistance, and by the level change of this terminal from level "H" to level "L", it can be determined that the control circuit has completed execution of the reset process.

In the second discrimination method, a signal indicating that the time period elapsed since the control circuit completed execution of the last reset process is equal to or longer than a specified time period can be used as a second discriminant reference signal. In this case, the block circuit for blocking the control signal by using the second discrimination method can be formed by a circuit for executing AND logical operation of the second discriminant reference signal and the control signal.

In the second discrimination method, by using the signal for indicating that the control circuit has completed execution of the reset process, it can be readily determined that the control signal was outputted from the control circuit in abnormal condition.

Additionally, it can also be determined that the control circuit is in abnormal condition as repeating the reset process. For example, when the control circuit executes the reset process two or more times at time intervals shorter than the specified time period before a control signal is outputted from the control circuit, it is determined that the control signal is abnormal.

(Third Discrimination Method)

The control circuit outputs a repeated signal (for example, a rectangle wave signal) of a specified frequency during operation. An appropriate output terminal is selected as an output terminal for outputting the repeated signal. Therefore, unless a control signal is outputted from the control circuit, there is a possibility that the control circuit is in abnormal condition.

Therefore, in the third discrimination method, when a control signal was outputted from the control circuit in the state in which a repeated signal was not outputted from the control circuit, it is determined that a control signal was outputted from the control circuit in abnormal condition.

In the third discrimination method, a signal indicating that a repeated signal of a specified frequency is not outputted from the control circuit can be used as a third discriminant reference signal. In this case, the block circuit for blocking the control signal by using the third discrimination method can be formed, for example, by a circuit for executing AND logical operation of the third discriminant reference signal and the control signal.

In the third discrimination method, by using the repeated signal for indicating the operating status of the control circuit, it can be readily determined that the control signal was outputted from the control circuit in abnormal condition.

Further, the above mentioned first to third discrimination methods may be used in combination to determine that the control signal was outputted from the control circuit in abnormal condition. For example, a combination of the first and second discrimination methods, a combination of the first to third discrimination methods, a combination of the first and third discrimination methods, or a combination of the second and third discrimination methods may be used to determine that the control signal was outputted from the control circuit in abnormal condition. Further, the block circuit for blocking the control signal can be formed by a circuit for executing AND logical operation of the combination of the first to third discriminant reference signals and the control signal.

By using the first to third discrimination methods in combination, it can be readily and reliably determined that the control signal was outputted from the control circuit in abnormal condition.

Thus, according to the invention, a movable element can be prevented from being moved by malfunctioning of the control circuit. Other objects, features and advantages of the invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide improved driving power tools and method for using such driving power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
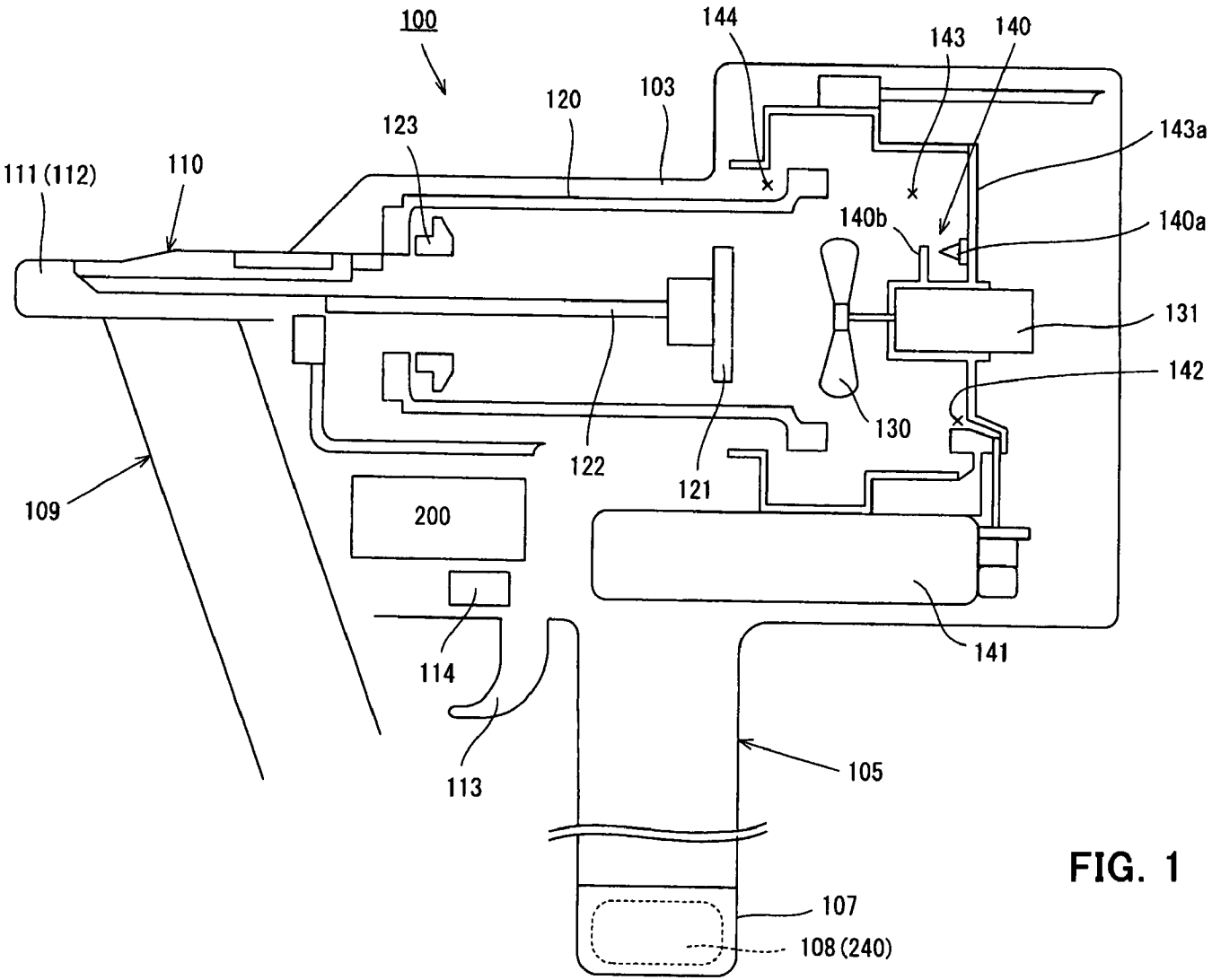
FIG. 1 is a schematic view showing the entire construction of a combustion driving power tool in a first embodiment of the invention.

A representative embodiment of the driving power tool according to the present invention is now described with reference to the drawings. FIG. 1 is a schematic view showing the entire construction of a representative embodiment of the driving power tool according to the invention. Representative combustion driving power tool (also referred to as a combustion nailing machine) 100 performs an operation of driving nails into a workpiece by utilizing pressure (combustion pressure) generated by combustion of flammable gas. In the description hereinafter, the side of a nail ejection part 110 (the left side as viewed in FIG. 1) is taken as the front side, and the opposite side (the right side as viewed in FIG. 1) as the rear side.

The representative combustion driving power tool (hereinafter referred to as a nailing machine) 100 comprises a housing 103, a handgrip 105, a magazine 109, a nail ejection part 110 and a trigger 113.

The housing 103 houses a cylinder 120, a piston 121, a driver 122 integrally formed with the piston 121, a cushion rubber 123, a fan 130, a motor 131, a spark plug 140, a gas cylinder 141, a jet 142, a combustion chamber 143, an exhaust port 144 and a control unit 200.

The handgrip 105 has a grip part which is held by a user during operation of the nailing machine 100. A holder 107 in which a battery 108 is housed is removably attached to the lower end of the handgrip 105. Further, a battery voltage detecting circuit 108*a* (see FIG. 2) is provided for detecting the voltage of the battery 108.

Further, the trigger 113 is disposed forward of the handgrip 105. The installation position and the shape of the trigger 113 is set such that the user can depress the trigger 113 while holding the grip part of the handgrip 105. A trigger switch 114 is provided which outputs an operation signal for indicating the state of operation of the trigger 113. When an operation signal for indicating that the trigger 113 is operated, an ignition circuit 140 (see FIG. 2) is actuated, which effects ignition of the spark plug 140 which will be described below in detail.

The trigger 113 is a feature that corresponds to the "operation instructing section", and the trigger switch 114 that outputs an operation signal for indicating the state of operation of the trigger 113 is the "operation switch" according to this invention. Further, the operation signal that is outputted from the trigger switch 114 when the trigger 113 is operated is a feature that corresponds to the "operation signal for instructing driving of the movable element" according to this invention.

The magazine 109 is mounted to the nail ejection part 110 formed on the front end of the housing 103 of the nailing machine 101. The magazine 109 contains numerous nails N connected with each other. The nails N in the magazine 109 are sequentially fed into the ejection part 110. The construction of the magazine 109 itself is well-known and thus will not be explained in further detail.

A contact arm 111 is mounted on the front end of the ejection part 110. The contact arm 111 can slide with respect to the ejection part 110 in the longitudinal direction of the ejection part 110 (the longitudinal direction of the nailing machine 101). A spring (not shown) is provided which generates a spring force for moving the contact arm 111 toward the front end side (forward) of the ejection part 110. Further, a contact arm switch 112 is provided for detecting that the contact arm 111 is pressed against the workpiece and moved rearward (leftward as viewed in FIG. 1) with respect to the ejection part 110.

The cylinder 120 comprises a piston accommodating part that communicates with the combustion chamber 143 and extends in the longitudinal direction of the nailing machine 100. The piston 121 is slidably disposed within the cylinder 120. When flammable gas within the combustion chamber 143 is burned by actuation of the ignition circuit 250, the piston 121 is moved forward (leftward as viewed in FIG. 1) within the cylinder 120 by combustion pressure of the flammable gas. A cushion rubber (or bumper) 123 is disposed in the front region of the cylinder 120. When the piston 121 is moved forward (toward the front end) at high speed by combustion pressure, the cushion rubber 123 absorbs the kinetic energy of the piston 121 and alleviates the impact of the piston 121. The driver 122 that moves together with the piston 121 moves the nail in the ejection part 110 toward the workpiece (toward the front end) (leftward as viewed in FIG. 1). Thus, the operation of driving nails into the workpiece is performed.

The combustion chamber 143 is a combustion space in which flammable gas is burned and which is designed as a space defined by a combustion chamber wall 143*a*, the cylinder 120 and the piston 121. The fan 130 that is driven by the motor 131 and the spark plug 140 are disposed within the combustion chamber 143.

The gas cylinder 141 is filled with flammable gas (for example, liquefied flammable gas). The flammable gas filled in the gas cylinder 141 is supplied to the jet 142 of the combustion chamber 143 via a gas supply path. At this time, air is also supplied into the combustion chamber 143. The fan 130 is driven when the flammable gas is supplied to the combustion chamber 143, and serves to mix and stir the flammable gas and air which are supplied into the combustion chamber 143 via the jet 142. As a result, the concentration of the mixture is evened up within the combustion chamber 143.

The spark plug 140 includes two electrodes 140*a*, 140*b* which are opposed to each other. A high voltage is placed between the electrodes 140*a*, 140*b* of the spark plug 140 by the ignition circuit 250 in the state in which the mixture is supplied into the combustion chamber 143. As a result, a spark is generated between the electrodes 140*a*, 140*b*, and the flammable gas in the combustion chamber 143 is burned. Then the above-described piston 121 and the driver 122 are moved to the front end by combustion pressure of the flammable gas. The combustion gas in the combustion chamber 143 is discharged out of the combustion chamber 143 through the exhaust port 144 formed between the combustion chamber wall 143*a* and the cylinder 120.

The driver 122 is a feature that corresponds to the "movable element that moves a material to be driven in a driving direction" according to this invention. Further, the piston 121, the spark plug 140 and the combustion chamber 143 form the "drive unit that drives the movable element" according to this invention. The ignition circuit 250 is a feature that corresponds to the "actuation circuit that actuates the drive unit" according to this invention.

Figure 2:
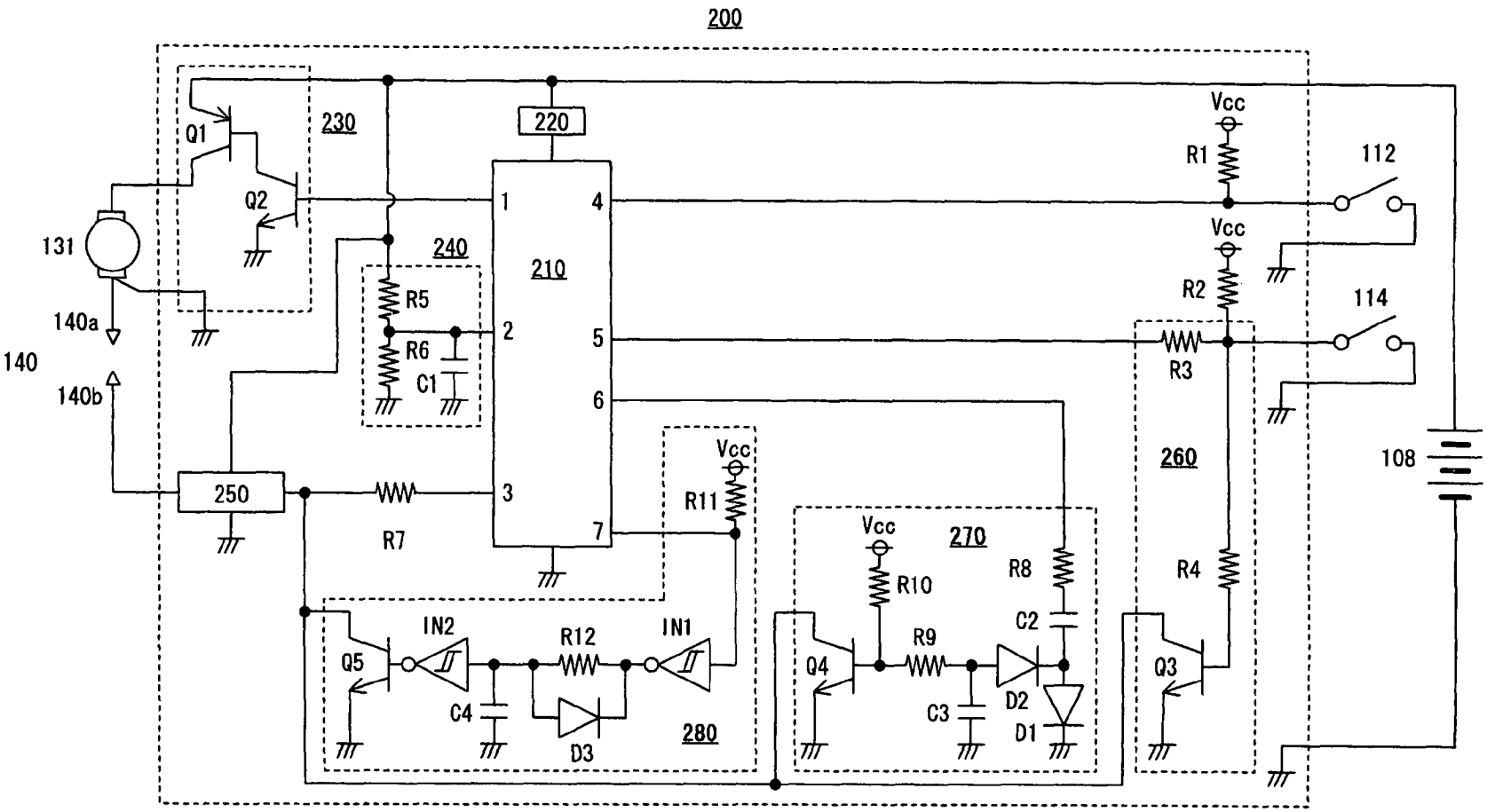
FIG. 2 is a schematic diagram showing a control unit of the first embodiment.
Figure 3:
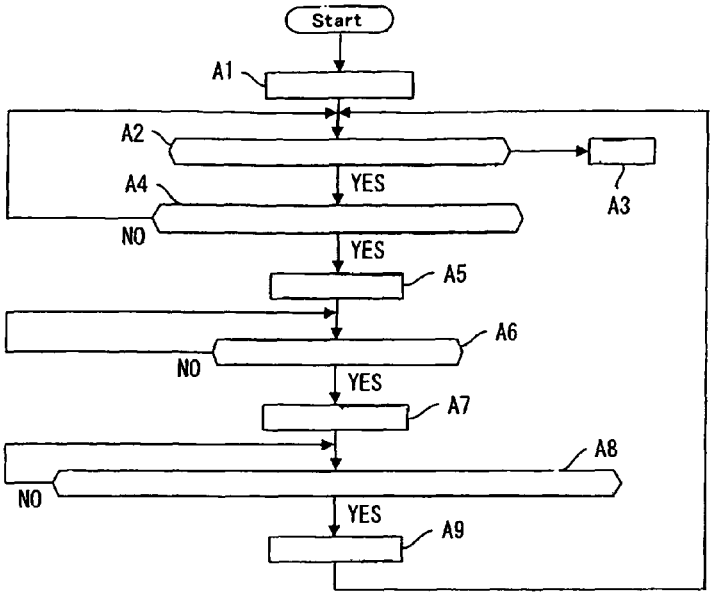
FIG. 3 is a flow chart for illustrating overall operation of the first embodiment.

The control unit 200 for controlling application of a high voltage between the electrodes 140*a*, 140*b* of the spark plug 140 is now explained with reference to FIG. 2. The control unit 200 includes a control circuit 210, a regulator (voltage regulating circuit) 220, a motor driving circuit 230, a battery voltage detecting circuit 240, the ignition circuit 250, a trigger operation detecting circuit 260, a repeated signal detecting circuit 270 and a reset operation detecting circuit 280.

The regulator 220 regulates the voltage of the battery 108 to a specified voltage and applies the voltage to the control circuit 210. Various kinds of known regulators can be used as the regulator 220. The motor driving circuit 230 drives the fan 130. In this embodiment, the motor driving circuit 230 includes a PNP transistor Q1 disposed between the battery 108 and the motor 131, and an NPN transistor Q2 that regulates the base current of the PNP transistor Q1. The base of the NPN transistor Q2 is connected to terminal 1 of the control circuit 210. The battery voltage detecting circuit 240 detects the voltage of the battery 108. In this embodiment, the battery voltage detecting circuit 240 includes resistors R5, R6 and a capacitor C1. A connection between the resistors R5 and R6 is connected to terminal 2 of the control circuit 210. The ignition circuit 250 is connected to terminal 3 of the control circuit 210. The control circuit 210 outputs an ignition signal from terminal 3. Operation of the ignition circuit 250 will be described below in detail. The ignition signal that is outputted from terminal 3 is a feature that corresponds to the "control signal that is outputted from the control circuit" according to this invention.

The contact arm switch 112 is connected between a power source Vcc and a ground via a resistor R1. A connection between the resistor R1 and the contact arm switch 112 is connected to terminal 4 of the control circuit 210. In this embodiment, a moving contact and a fixed contact of the contact arm switch 112 are not in contact with each other when the contact arm 111 is not pressed against the workpiece (in the off position). At this time, a level "H" contact arm state signal for indicating that the contact arm 111 is not pressed against the workpiece is inputted to the terminal 4. In other words, the level "H" contact arm state signal is outputted from the contact arm switch 112. Further, the moving contact and the fixed contact of the contact arm switch 112 are in contact with each other when the contact arm 111 is pressed against the workpiece (in the on position). At this time, a level "L" contact arm state signal for indicating that the contact arm 111 is pressed against the workpiece is inputted to the terminal 4. In other words, the level "L" contact arm state signal is outputted from the contact arm switch 112.

The trigger switch 114 is connected between a power source Vcc and a ground via a resistor R2. A connection between the resistor R2 and the trigger switch 114 is connected to terminal 5 of the control circuit 210 via a resistor R3. In this embodiment, a moving contact and a fixed contact of the trigger switch 114 are not in contact with each other when the trigger 113 is not operated (in the off position). At this time, a level "H" operation signal for indicating that the trigger 113 is not operated is inputted to the terminal 5. In other words, the level "H" operation signal is outputted from the trigger switch 114. Further, the moving contact and the fixed contact of the trigger switch 114 are in contact with each other when the trigger 113 is operated (in the on position). At this time, a level "L" operation signal for indicating that the trigger 113 is operated (the driver 122 is driven) is inputted to the terminal 5. In other words, the level "L" operation signal is outputted from the trigger switch 114.

The trigger operation detecting circuit 260 detects the state of operation of the trigger 113. In this embodiment, the trigger operation detecting circuit 260 detects the state of operation of the trigger 113 based on the operation signal outputted from the trigger switch 114.

In this embodiment, the trigger operation detecting circuit 260 includes the resistors R3, R4 and an NPN transistor (switching element) Q3. One end of the resistor R4 is connected to the connection between the trigger switch 114 and the resistor R2. The other end of the resistor R4 is connected to a base terminal of the NPN transistor Q3.

The NPN transistor Q3 conducts when the trigger 113 is not operated (in the off position) or when the level "H" operation signal for indicating that the driver 122 is not driven is outputted from the trigger switch 114. On the other hand, the NPN transistor Q3 does not conduct when the trigger 113 is operated (in the on position) or when the level "L" operation signal for indicating that the driver 122 is driven is outputted from the trigger switch 114.

As a result, a collector terminal of the NPN transistor Q3 is closed when the trigger 113 is not operated, while it is opened when the trigger 113 is operated.

The control circuit 210 outputs a repeated signal (for example, rectangle wave signal) of a specified frequency from terminal 6 during operation. Therefore, if a repeated signal of a specified frequency is not outputted from the control circuit 210 during operation, there is a possibility that the control circuit 210 is in abnormal condition.

The repeated signal detecting circuit 270 detects whether a repeated signal of a specified frequency is outputted from the terminal 6 of the control circuit 210.

In this embodiment, the repeated signal detecting circuit 270 includes resistors R8, R9, R10, capacitors C2, C3, diodes D1, D2 and an NPN transistor (switching element) Q4. A series circuit of the resistor R8, the capacitor C2 and the diode D1 (in the direction of a ground terminal) is connected between the terminal 6 of the control circuit 210 and the ground terminal. Further, a series circuit of the resistors R10, R9 and the capacitor C3 is connected between a power source Vcc and a ground terminal. The diode D2 (in the direction of a connection between the capacitor C2 and the diode D1) is connected between a connection between the capacitor C2 and the diode D1 and a connection between the capacitor C3 and the resistor R9. A connection between the resistors R9, R10 is connected to a base terminal of the NPN transistor Q4.

It is configured such that, when a repeated signal of a specified frequency is outputted from the terminal 6 of the control circuit 210, the capacitor C3 discharges at discharge intervals corresponding to the specified frequency and the voltage of the capacitor C3 is below the voltage at which the NPN transistor Q4 conducts. Thus, when a repeated signal of a specified frequency is outputted from the terminal 6 of the control circuit 210, the NPN transistor Q4 does not conduct. On the other hand, when a repeated signal of a specified frequency is not outputted from the terminal 6 of the control circuit 210, the discharge intervals (charging period) of the capacitor C3 becomes longer and the voltage of the capacitor C3 exceeds or equals the voltage at which the NPN transistor Q4 conducts.

Therefore, the collector terminal of the NPN transistor Q4 is opened when a repeated signal of a specified frequency is outputted from the terminal 6 of the control circuit 210; otherwise it is closed.

The control circuit 210 executes a reset process at power-on. However, normally, the control circuit 210 hardly executes a reset process during operation (when the power is on). Therefore, if the control circuit 210 executes a reset process during operation, there is a possibility that the control circuit 210 is in abnormal condition.

In this respect, it is necessary to distinguish whether a reset process has been executed at power-on or during operation. Generally, nail driving operation is started after a certain period of time since the power was turned on. Therefore, distinction between a reset process executed at power-on and a reset process executed during operation can be made by determining the time period elapsed since completion of execution of a reset process. Specifically, when an ignition signal (control signal) was outputted from the control circuit 210 within a specified time period after completion of execution of a reset process, it can be determined that the ignition signal (control signal) was outputted from the control circuit 210 in abnormal condition. This specified time period is shorter than a time period from the instant when the power is turned on to the instant when the operation switch is first operated.

Generally, when the micro computer (control circuit) is in the resetting state (under execution of a reset process), a terminal is placed in the input state. Therefore, a power source is connected via a pull-up resistor to the terminal which is placed in the input state when the micro computer (control circuit) is in the resetting state, and this terminal is placed in level "L" when the micro computer (control circuit) is in the reset released state (execution of the reset process is completed). With such arrangement, it can be determined whether the micro computer (control circuit) has completed execution of the reset process, based on the state of this terminal.

In this embodiment, a power source Vcc is connected via a resistor R11 (pull-up resistor) to terminal 7 which is placed in the input state when the control circuit 210 is in the resetting state. Further, the terminal 7 is placed in level "L" when the control circuit 210 is in the reset released state. In this case, the terminal 7 is placed in level "H" when the control circuit 210 is in the resetting state (during execution of the reset process), while the terminal 7 is placed in level "L" when the control circuit 210 is in the reset released state (execution of the reset process is completed). Thus, by the level change of the terminal 7 from level "H" to level "L", it can be determined that the control circuit 210 has completed execution of the reset process.

The reset operation detecting circuit 280 detects whether the time period elapsed since the control circuit 210 completed execution of the last reset process is equal to or longer than a specified time period.

As described above, in this embodiment, when the control circuit 210 completes execution of the reset process, the level of the terminal 7 of the control circuit 210 is changed from level "H" to level "L". The reset operation detecting circuit 280 detects whether the time period elapsed since the level of the terminal 7 of the control circuit 210 is changed from level "H" to level "L" is shorter or longer than the specified time period.

In this embodiment, the reset operation detecting circuit 280 includes resistors R11, R12, a capacitor C4, a diode D3, inverters IN1, IN2 and an NPN transistor Q5. The resistor (pull-up resistor) R11 is connected between the terminal 7 of the control circuit 210 and the power source Vcc. A series circuit consisting of the inverter IN1, a parallel circuit of the resistor R12 and the diode D3 (in the direction of the inverter IN1) and the capacitor C4 is connected between a connection between the terminal 7 and the resistor R11 and the ground terminal. A connection between the resistor R12 and the capacitor C4 is connected to the base terminal of the NPN transistor Q5 via the inverter IN2. Here it is set such that the NPN transistor Q5 does not conduct when the voltage of the capacitor C4 is equal to or higher than a specified voltage.

The capacitor C4 discharges via the diode D3 when the terminal 7 of the control circuit 210 is in level "H" (in the resetting state). On the other hand, the capacitor C4 is charged via the resistor R12 when the terminal 7 of the control circuit 210 is in level "L" (in the reset released state). When the voltage of the capacitor C4 reaches the specified voltage, the NPN transistor Q5 stops conducting. Here the time period from the instant when the level of the terminal 7 is changed from level "H" to level "L" to the instant when the voltage of the capacitor C4 reaches the specified voltage is set, for example, to be shorter than the time period from the instant when the power is turned on to the instant when the trigger 113 is first operated.

Therefore, the collector terminal of the NPN transistor Q5 is closed until the time period elapsed since the control circuit 210 completed execution of the reset process reaches the specified time period, while it is opened when it reaches the specified time period.

Further, when the control circuit 210 successively executes reset process at intervals shorter than the specified time period, the voltage of the capacitor C4 is held below the specified voltage. In this case, the collector terminal of the NPN transistor Q5 is closed all the time.

The control circuit 210 outputs a motor control signal for controlling the motor driving circuit 230 from the terminal 1 and also outputs an ignition signal for controlling the ignition circuit 250 from the terminal 3, based on the contact arm state signal that is inputted from the contact arm switch 112 to the terminal 4, the operation signal that is inputted from the trigger switch 114 to the terminal 5, and the battery voltage that is inputted from the battery voltage detecting circuit 240 to the terminal 2. Further, during operation, the control circuit 210 outputs a repeated signal from the terminal 6. The control circuit 210 sets the terminal 7 in the input state in the resetting state and sets it in level "L" in the reset released state.

The collector terminal of the NPN transistor Q3 of the trigger operation detecting circuit 260, the collector terminal of the NPN transistor Q4 of the repeated signal detecting circuit 270, and the collector terminal of the NPN transistor Q5 of the reset operation detecting circuit 280 are connected to the connection between the terminal 3 and the ignition circuit 250. Therefore, the ignition signal outputted from the terminal 3 is inputted to the ignition circuit 250 only when all of the NPN transistors Q3, Q4, Q5 are open. Specifically, in this embodiment, only when the trigger switch 113 is operated, and the time period elapsed since completion of execution of the last reset process is equal to or longer than the specified time period, and a repeated signal is outputted from the control circuit 210, the ignition signal outputted from the terminal 3 of the control circuit 210 is inputted to the ignition circuit 250.

The NPN transistor Q3 of the trigger operation detecting circuit 260, the NPN transistor Q4 of the repeated signal detecting circuit 270 and the NPN transistor Q5 of the reset operation detecting circuit 280 form the "blocking circuit for blocking passage of an abnormal control signal" according to this invention.

Further, the signal for indicating that the trigger switch 113 is operated (the collector terminal of the NPN transistor Q3 is open) is a feature that corresponds to the "first discriminant reference signal" according to this invention. The signal for indicating that the time period elapsed since the control circuit 210 completed execution of the last reset process is equal to or longer than the specified time period (the collector terminal of the NPN transistor Q4 is open) is a feature that corresponds to the "second discriminant reference signal" according to this invention. The signal for indicating that a repeated signal is outputted from the control circuit 210 (the collector terminal of the NPN transistor Q5 is open) is a feature that corresponds to the "third discriminant reference signal" according to this invention.

Further, the interconnect line between the terminal 3 of the control circuit 210 and the ignition circuit 250 and the NPN transistors Q3, Q4, Q5 form a circuit for executing AND logical operation of the control signal and the first to third discriminant reference signals.

Operation of the nailing machine 100 of this embodiment is now explained.

First, operation of the control circuit 210 is explained with reference to the flow chart of FIG. 3 and FIGS. 6 to 9 showing the operation.

When the power is turned on, a reset process is executed in step A1. Upon completion of the reset process, go to step A2.

The terminal 7 is in level "H" during execution of a reset process, and the terminal 7 is in level "L" in the reset completed state (reset released state). Further, when execution of the reset process is completed, a repeated signal (rectangle wave signal) of a specified frequency is outputted from the terminal 6.

In step A2, it is determined whether the remaining battery charge of the battery 108 is equal to or larger than a specified amount or not. The remaining battery charge is determined based on the voltage of the battery 108 which is detected by the battery voltage detecting circuit 240. For example, it is determined whether the battery voltage is equal to or higher than a specified voltage. If the remaining battery charge is equal to or larger than the specified amount, go to step A4, and if the remaining battery charge is smaller than the specified amount, go to step A3.

In step A3, a stop process is executed. Further, an instruction to change the battery is issued by using a light-emitting device or a loudspeaker.

In step A4, it is determined whether the contact arm 111 is pressed against the workpiece W and the contact arm switch 112 is turned on. In this embodiment, it is determined whether a contact arm state signal of level "L" is inputted to the terminal 4. If the contact arm switch 112 is on, go to step A5, and if not, return to step A2.

In step A5, the fan 130 is rotated. Specifically, a motor control signal is outputted from the terminal 1 to the motor driving circuit 230, so that the motor 131 is driven (see FIG. 6).

In step A6, it is determined whether the trigger 113 is operated and the trigger switch 114 is turned on. In this embodiment, it is determined whether an operation signal of level "L" is inputted to the terminal 5. If the trigger switch 113 is on, go to step A7, and if not, stand by.

In step A7, an ignition signal for actuating the ignition circuit 250 is outputted from the terminal 3. The ignition signal outputted from the terminal 3 is inputted to the ignition circuit 250 only when the NPN transistor Q3 of the trigger operation detecting circuit 260, the NPN transistor Q4 of the repeated signal detecting circuit 270, and the NPN transistor Q5 of the reset operation detecting circuit 280 do not conduct. When the ignition signal is inputted, the ignition circuit 250 applies a high voltage between the electrodes 140*a*, 140*b* of the spark plug 140 and generates a spark. As a result, flammable gas within the combustion chamber 143 is burnt, and the piston 121 and the driver 122 are moved toward the front end by the combustion pressure (see FIG. 7).

Figure 8:
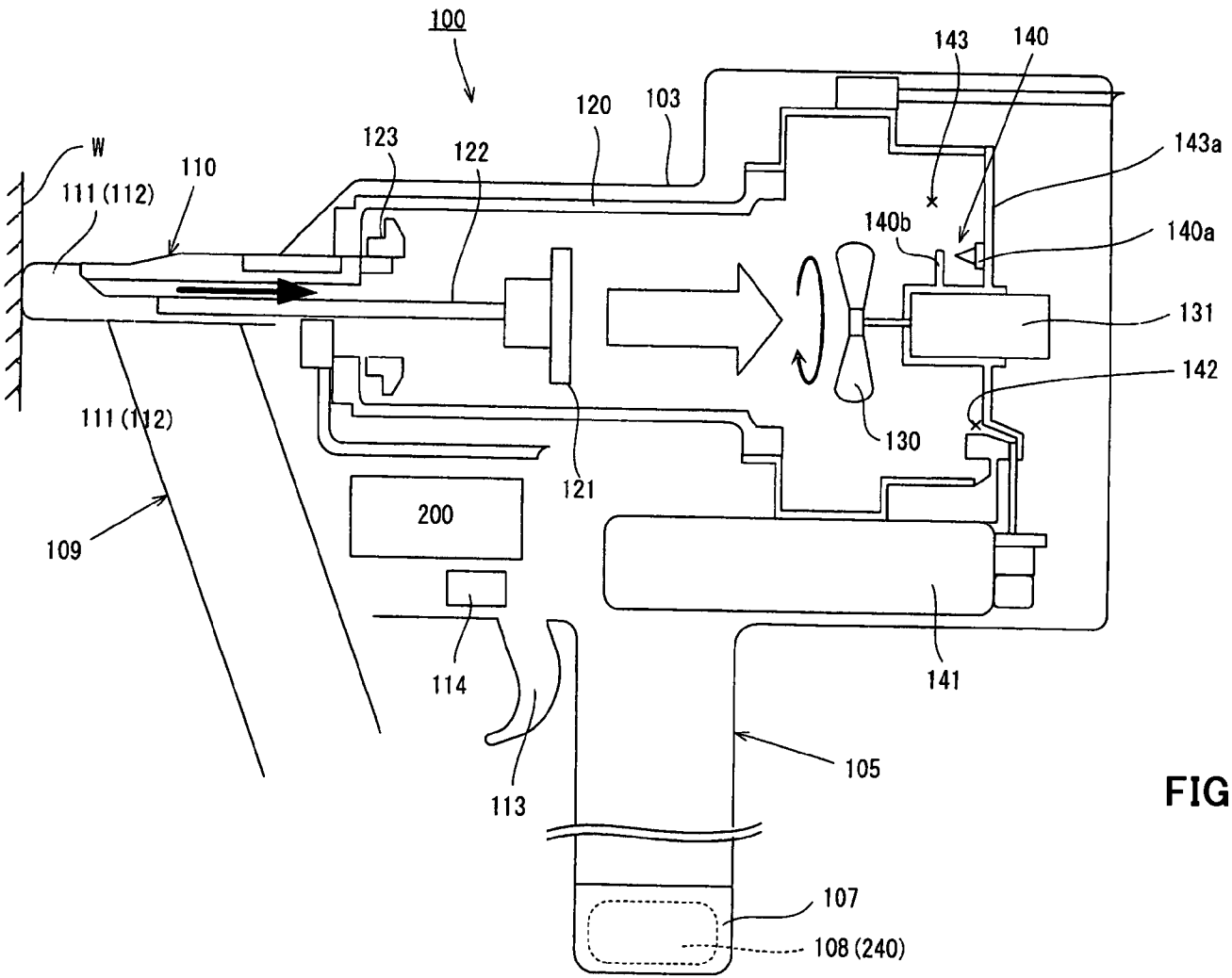
FIG. 8 illustrates driving operation of the first embodiment.

After a nail is driven into the workpiece W, the piston 121 and the driver 122 are moved back to the rearward position (see FIG. 8).

Figure 9:
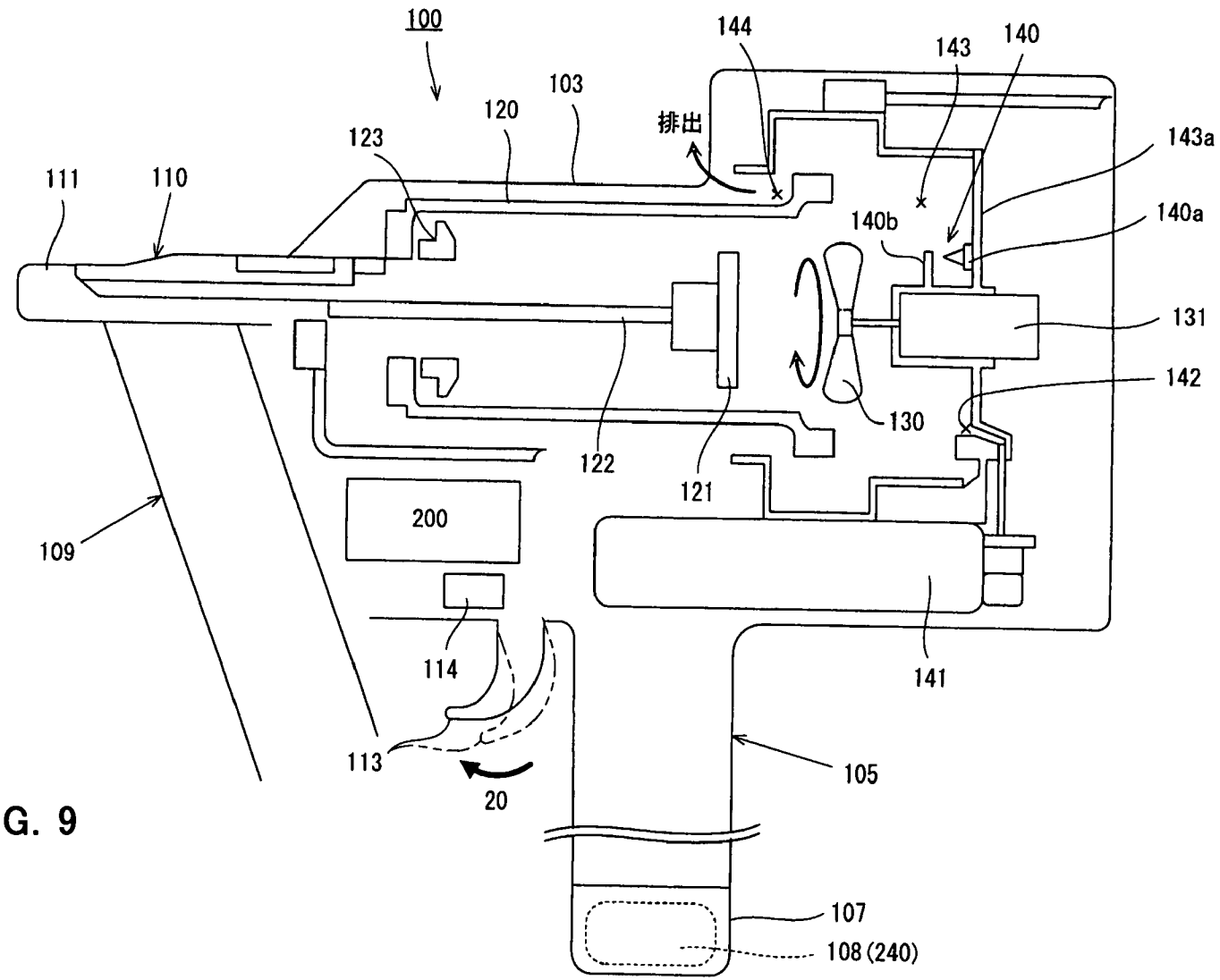
FIG. 9 illustrates driving operation of the first embodiment.

Further, the flammable gas within the combustion chamber 143 is discharged out of the combustion chamber 143 through the exhaust port 144 formed between the combustion chamber wall 143*a* and the cylinder 120 (see FIG. 9).

In step A8, it is determined whether the contact arm 111 is moved away from the workpiece and the contact arm switch 112 is turned off. Further, it is also determined whether the trigger 113 is released and the trigger switch 114 is turned off. If the contact arm switch 112 and the trigger switch 114 are turned off, go to step A9, and if not, stand by.

In step A9, outputting of a motor control signal from the terminal 1 is stopped, so that rotation of the fan 130 is stopped.

Figure 4:
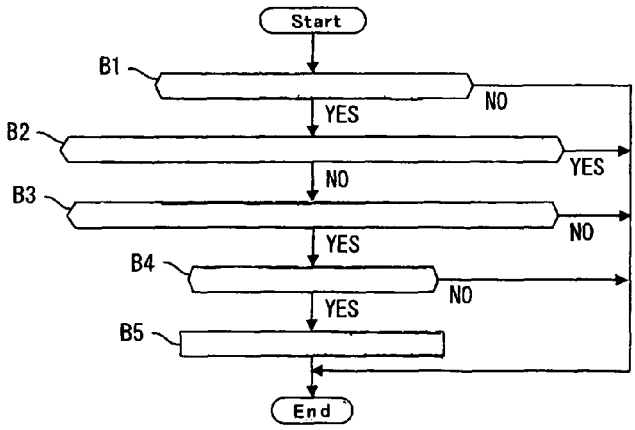
FIG. 4 is a flow chart for illustrating main control operation of the first embodiment.

Next, operation for preventing the ignition circuit 250 from operating under an abnormal ignition signal (control signal) outputted from the terminal 3 of the control circuit 210 is explained. FIG. 4 is a flow chart showing a first embodiment of operation for preventing the ignition circuit 250 from operating under an abnormal ignition signal.

As the methods for preventing the ignition circuit 250 from operating when the ignition signal is abnormal, a method may be used in which the ignition circuit 250 detects an abnormal ignition signal and interrupts ignition operation. Alternatively, another method may be used in which an abnormal ignition signal is prevented from being inputted into the ignition circuit 250. In this embodiment, the latter method of preventing an abnormal ignition signal from being inputted into the ignition circuit 250 is used.

The process shown in FIG. 4 is started with appropriate timing.

In step B1, it is determined whether an ignition signal is outputted from the terminal 3 of the control circuit 210. If the ignition signal is outputted, go to step B2, and if not, the process is ended.

In step B2, it is determined whether the control circuit 210 executed a reset process within a specified time period before now. Specifically, it is determined whether the time period elapsed since the control circuit 210 completed execution of the last reset process is equal to or longer than the specified time period. The process of step B2 is executed by the reset operation detecting circuit 280. If the reset process was not executed within the specified time period, go to step B3, and if such was executed, passage of the ignition signal is blocked and the process is ended.

In step B3, it is determined whether a repeated signal is outputted from the terminal 6 of the control circuit 210. The process of step B3 is executed by the repeated signal detecting circuit 270. If the repeated signal is outputted from the control circuit 210, go to step B4, and if not, passage of the ignition signal is blocked and the process is ended.

In step B4, it is determined whether the trigger switch 114 is on. The process of step B4 is executed by the trigger operation detecting circuit 260. If the trigger switch 114 is on, go to step B5, and if not, passage of the ignition signal is blocked and the process is ended.

In step B5, the ignition signal is passed and inputted to the ignition circuit 250.

Figure 5:
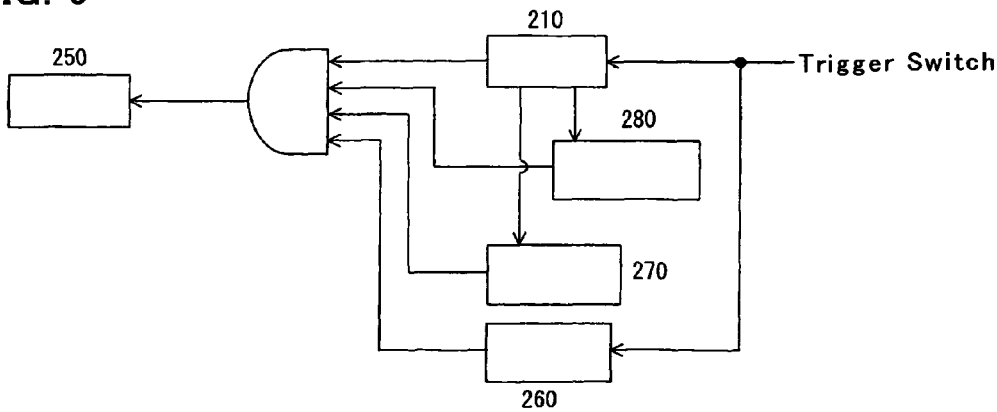
FIG. 5 is a block diagram showing an essential part of the control unit of the first embodiment.
Figure 6:
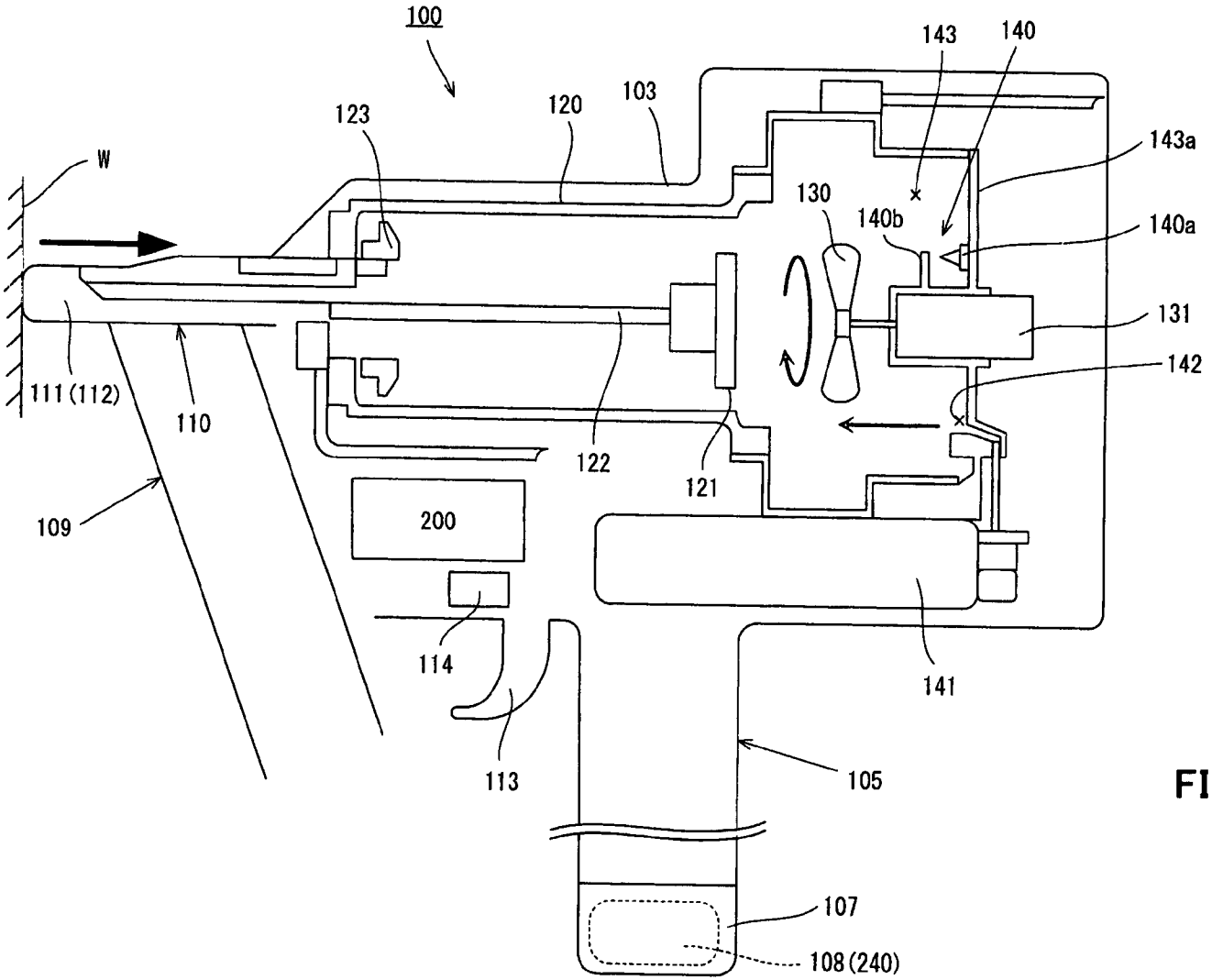
FIG. 6 illustrates driving operation of the first embodiment.
Figure 7:
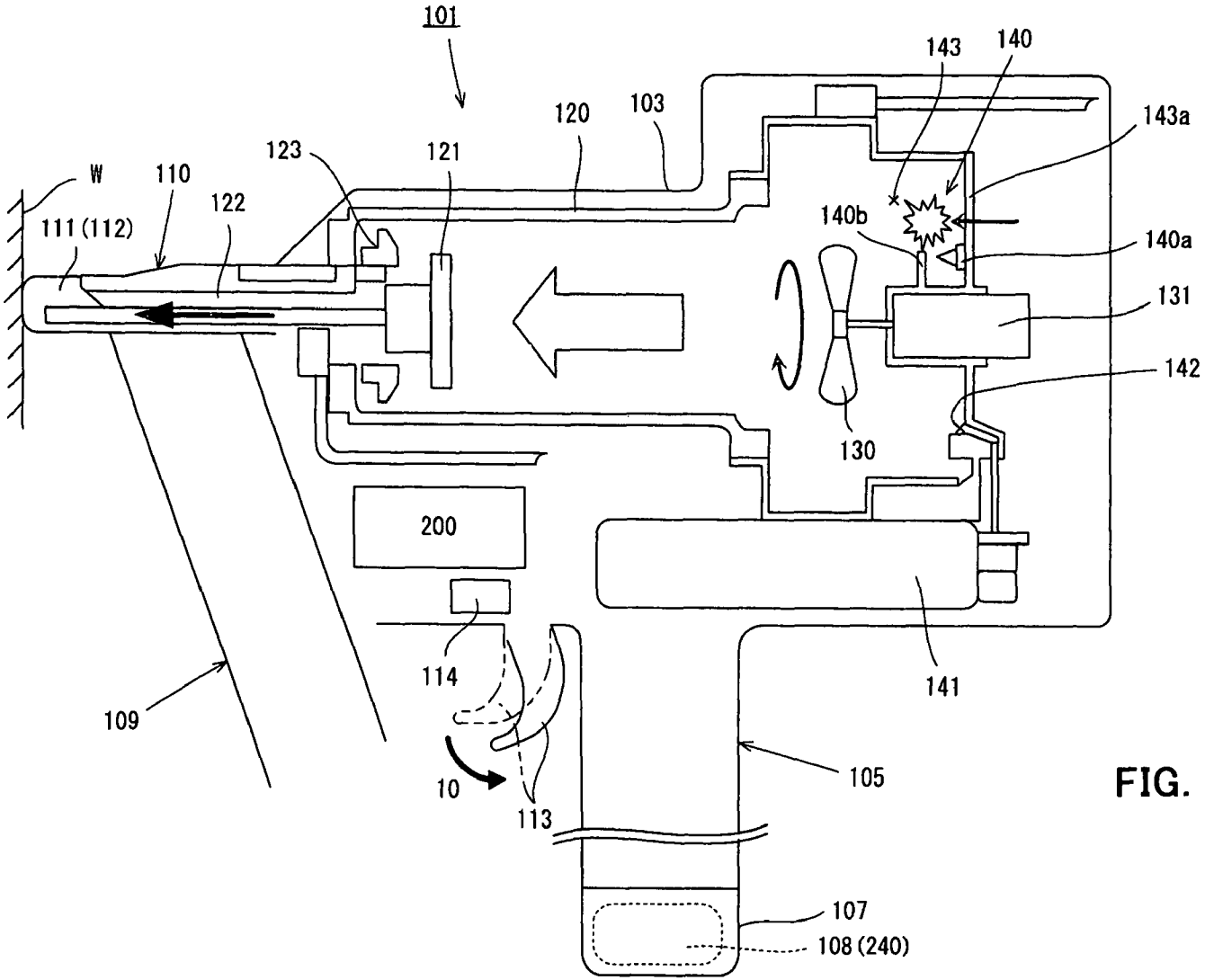
FIG. 7 illustrates driving operation of the first embodiment.

FIG. 5 shows an example of a block circuit for executing the process shown in FIG. 4. The block circuit shown in FIG. 5 is formed by a circuit for executing AND logical operation of an ignition signal outputted from the control circuit 210, a first discriminant reference signal outputted from the trigger operation detecting circuit 260, a second discriminant reference signal outputted from the reset operation detecting circuit 280 and a third discriminant reference signal outputted from the repeated signal detecting circuit 270.

The trigger operation detecting circuit 260 outputs a first discriminant reference signal of level "H" when it detects that an operation signal for instructing to drive the driver 122 is outputted from the trigger switch 114 (the NPN transistor Q3 does not conduct). The reset operation detecting circuit 280 outputs a second discriminant reference signal of level "H" when it detects that the control circuit 210 did not execute a reset process within a specified time period before now (the NPN transistor Q5 does not conduct). The repeated signal detecting circuit 270 outputs a third discriminant reference signal of level "H" when it detects that a repeated signal is outputted from the control circuit 210 (the NPN transistor Q4 does not conduct).

The process shown in FIGS. 4 and 5 is also referred to as a process for blocking the passage of the ignition signal (control signal) outputted from the control circuit 210 (a process for blocking input of the ignition signal to the ignition circuit 250) when any one of the first to third discriminant reference signals is not outputted from at least one of the trigger operation detecting circuit 260, the reset operation detecting circuit 280 and the repeated signal detecting circuit 270.

As a method of determining that the ignition signal was outputted from the control circuit 210 in abnormal condition, in the above-described method, conditions relating to the operation of the trigger 113, the time period elapsed since the control circuit 210 completed execution of the reset process, and the output of the repeated signal of a specified frequency from the control circuit 210 are considered. However, the method of determining that the ignition signal was outputted from the control circuit 210 in abnormal condition is not limited to this embodiment.

A second embodiment for determining that an ignition signal was outputted from the control circuit 210 in abnormal condition is now explained. In the second embodiment, only the condition relating to the operation of the trigger 113 is considered. In other words, only the trigger operation detecting circuit 260 is used.

The second embodiment of operation for preventing the ignition circuit 250 from operating under an abnormal ignition signal is explained with reference to a flow chart shown in FIG. 10.

Figure 10:
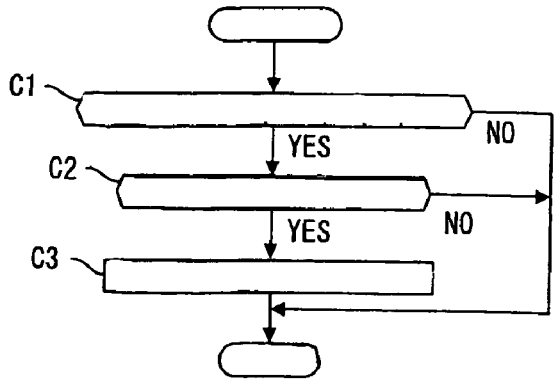
FIG. 10 is a flow chart for illustrating main control operation of a second embodiment of this invention.

The process shown in FIG. 10 is started with appropriate timing.

In step C1, it is determined whether an ignition signal (control signal) is outputted from the control circuit 210. If the ignition signal is outputted from the control circuit 210, go to step C2, and if not, the process is ended.

In step C2, it is determined whether the trigger switch 114 is on. If the trigger switch 114 is on, go to step C3, and if not, passage of the ignition signal is blocked and the process is ended.

In step C3, the ignition signal is passed and inputted to the ignition circuit 250.

Figure 11:
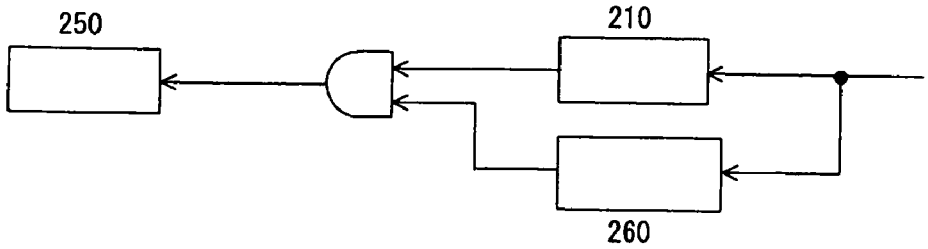
FIG. 11 is a block diagram showing an essential part of the control unit of the second embodiment.

FIG. 11 shows an example of a block circuit for executing the process shown in FIG. 10. The block circuit shown in FIG. 11 is formed by a circuit for executing AND logical operation of an ignition signal outputted from the control circuit 210 and a first discriminant reference signal outputted from the trigger operation detecting circuit 260.

The control circuit 210 outputs an ignition signal when the trigger 113 is operated. Therefore, when an ignition signal was outputted from the control circuit 210 in the state in which the trigger 113 was not operated, there is a possibility that the ignition signal was outputted from the control circuit in abnormal condition. Therefore, also by using the determining method of the second embodiment, the ignition circuit 250 can be prevented from malfunctioning under an abnormal ignition signal.

Next, a third embodiment for determining that an ignition signal was outputted from the control circuit 210 in abnormal condition is now explained. In the third embodiment, only the condition relating to the reset process of the control circuit is considered. In other words, only the reset operation detecting circuit 280 is used.

The third embodiment of operation for preventing the ignition circuit 250 from operating under an abnormal ignition signal is explained with reference to a flow chart shown in FIG. 12.

Figure 12:
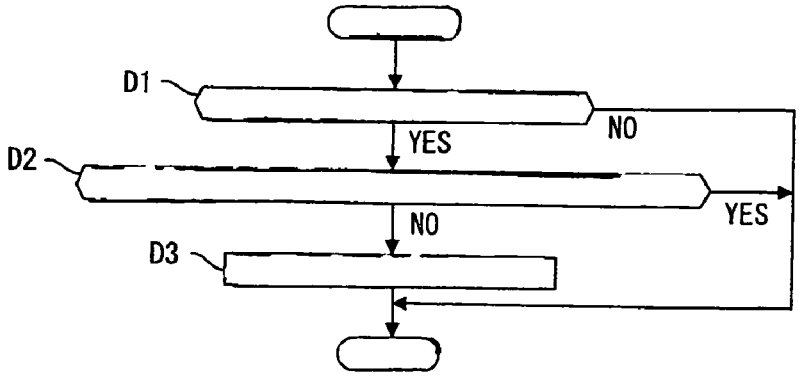
FIG. 12 is a flow chart for illustrating main control operation of a third embodiment of this invention.

The process shown in FIG. 12 is started with appropriate timing.

In step D1, it is determined whether an ignition signal is outputted from the control circuit 210. If the ignition signal is outputted from the control circuit 210, go to step D2, and if not, the process is ended.

In step D2, it is determined whether the control circuit 210 has executed a reset process within a specified time period before now. If the reset process has not been executed within the specified time period, go to step D3, and if such has been executed, passage of the ignition signal is blocked and the process is ended.

In step D3, the ignition signal is passed and inputted to the ignition circuit 250.

Figure 13:
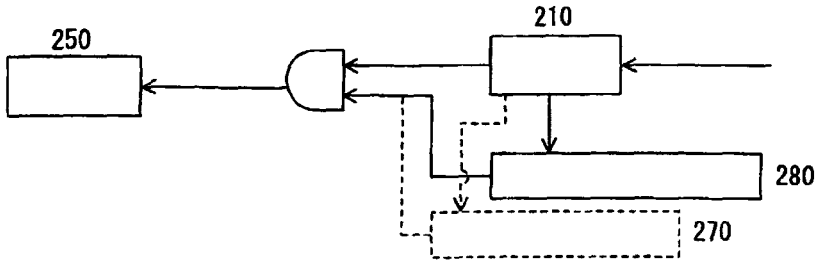
FIG. 13 is a block diagram showing an essential part of the control unit of the third embodiment.

FIG. 13 shows an example of a block circuit for executing the process shown in FIG. 12. The block circuit shown in FIG. 13 is formed by a circuit for executing AND logical operation of an ignition signal outputted from the control circuit 210 and a second discriminant reference signal outputted from the reset operation detecting circuit 280.

Further, as shown by dashed lines in FIG. 13, the repeated signal detecting circuit 270 may be used in place of the reset operation detecting circuit 280. Specifically, the block circuit may be formed by a circuit for executing AND logical operation of an ignition signal outputted from the control circuit 210 and a third discriminant reference signal outputted from the repeated signal detecting circuit 270.

The control circuit 210 hardly executes a reset process during operation. Further, the control circuit 210 outputs a repeated signal of a specified frequency during operation.

Therefore, also by using the determining method of the third embodiment, the ignition circuit 250 can be prevented from malfunctioning under an abnormal ignition signal.

Next, a fourth embodiment for determining that an ignition signal was outputted from the control circuit 210 in abnormal condition is now explained. In the fourth embodiment, the conditions relating to the reset process of the control circuit and the output of the repeated signal of a specified frequency from the control circuit are considered. In other words, the reset operation detecting circuit 280 and the repeated signal detecting circuit 270 are used.

The fourth embodiment of operation for preventing the ignition circuit 250 from operating under an abnormal ignition signal is explained with reference to a flow chart shown in FIG. 14.

Figure 14:
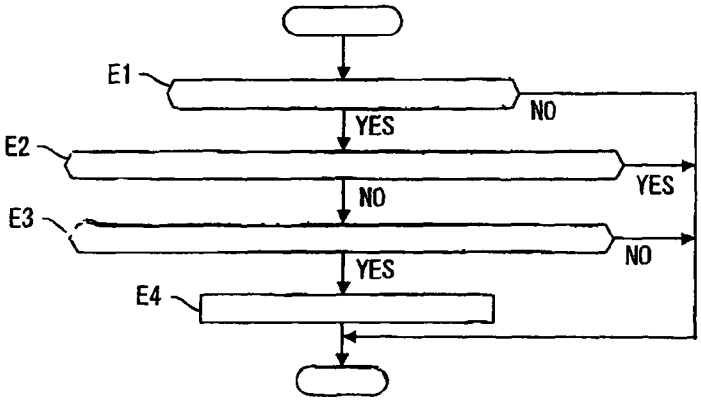
FIG. 14 is a flow chart for illustrating main control operation of a fourth embodiment of this invention.

The process shown in FIG. 14 is started with appropriate timing.

In step E1, it is determined whether an ignition signal is outputted from the control circuit 210. If the ignition signal is outputted, go to step E2, and if not, the process is ended.

In step E2, it is determined whether the control circuit 210 has executed a reset process within a specified time period before now. If the reset process has not been executed within the specified time period, go to step E3, and if such has been executed, passage of the ignition signal is blocked and the process is ended.

In step E3, it is determined whether a repeated signal is outputted from the control circuit 210. If the repeated signal is outputted from the control circuit 210, go to step E4, and if not, passage of the ignition signal is blocked and the process is ended.

In step E4, the ignition signal is passed and inputted to the ignition circuit 250.

Figure 15:
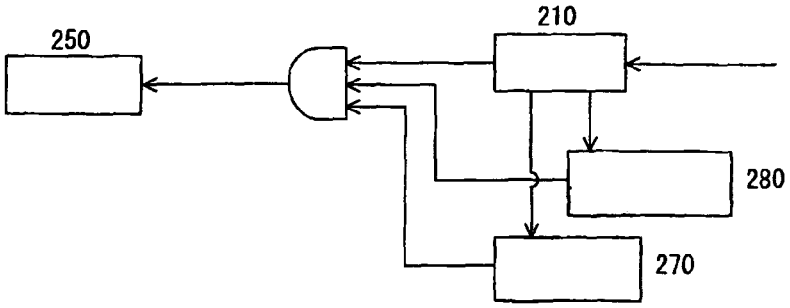
FIG. 15 is a block diagram showing an essential part of the control unit of the fourth embodiment.

FIG. 15 shows an example of a block circuit for executing the process shown in FIG. 14. The block circuit shown in FIG. 15 is formed by a circuit for executing AND logical operation of an ignition signal outputted from the control circuit 210, a second discriminant reference signal outputted from the reset operation detecting circuit 280 and a third discriminant reference signal outputted from the repeated signal detecting circuit 270.

In the fourth embodiment, in which the conditions relating to the reset process and the output of the repeated signal are considered, the ignition circuit 250 can be reliably prevented from malfunctioning under an abnormal ignition signal.

Next, a fifth embodiment for determining that an ignition signal was outputted from the control circuit 210 in abnormal condition is now explained. In the fifth embodiment, the conditions relating to the operation of the trigger 113 and the reset process of the control circuit are considered. In other words, the trigger operation detecting circuit 260 and the reset operation detecting circuit 280 are used.

The fifth embodiment of operation for preventing the ignition circuit 250 from operating under an abnormal ignition signal is explained with reference to a flow chart shown in FIG. 16.

Figure 16:
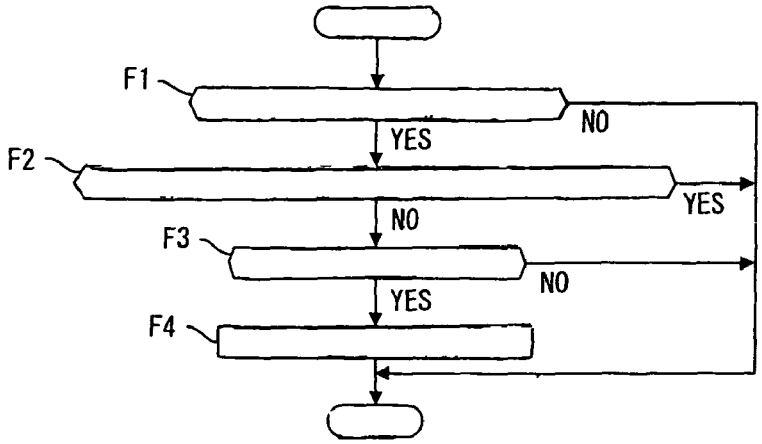
FIG. 16 is a flow chart for illustrating main control operation of a fifth embodiment of this invention.

The process shown in FIG. 16 is started with appropriate timing.

In step F1, it is determined whether an ignition signal is outputted from the control circuit 210. If the ignition signal is outputted, go to step F2, and if not, the process is ended.

In step F2, it is determined whether the control circuit 210 has executed a reset process within a specified time period before now. If the reset process has not been executed within the specified time period, go to step D3, and if such has been executed, passage of the ignition signal is blocked and the process is ended.

In step F3, it is determined whether the trigger switch 114 is on. If the trigger switch 114 is on, go to step F4, and if not, passage of the ignition signal is blocked and the process is ended.

In step F4, the ignition signal is passed and inputted to the ignition circuit 250.

Figure 17:
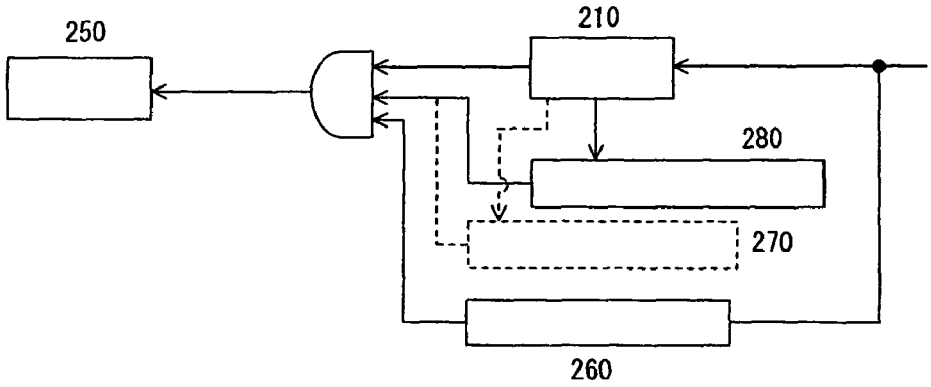
FIG. 17 is a block diagram showing an essential part of the control unit of the fifth embodiment.

FIG. 17 shows an example of a block circuit for executing the process shown in FIG. 16. The block circuit shown in FIG. 17 is formed by a circuit for executing AND logical operation of an ignition signal outputted from the control circuit 210, a first discriminant reference signal outputted from the trigger operation detecting circuit 260 and a second discriminant reference signal outputted from the reset operation detecting circuit 280.

Further, as shown by dashed lines in FIG. 17, the repeated signal detecting circuit 270 may be used in place of the reset operation detecting circuit 280. Specifically, the block circuit may be formed by a circuit for executing AND logical operation of an ignition signal outputted from the control circuit 210, a first discriminant reference signal outputted from the trigger operation detecting circuit 260 and a third discriminant reference signal outputted from the repeated signal detecting circuit 270.

In the fifth embodiment, in which the conditions relating to the trigger operation and the reset process or the output of the repeated signal are considered, the ignition circuit 250 can be reliably prevented from malfunctioning under an abnormal ignition signal.

As described, above, the ignition circuit can be prevented from malfunctioning under an ignition signal outputted from the control circuit when the ignition signal is abnormal. Particularly, by using the method of determining that the ignition signal was outputted from the control circuit in abnormal condition, as a method of determining that the ignition signal is abnormal, the ignition circuit can be readily prevented from malfunctioning under an abnormal ignition signal.

The present invention is not limited to the above embodiments, but rather, may be added to, changed, replaced with alternatives or otherwise modified.

The contact arm switch 112 and the trigger switch 114 can have various configurations. The process of detecting the state of the contact arm 111 and the process of detecting the state of operation of the trigger 113 in the control circuit 210, and the configuration of the trigger operation detecting circuit 260 are changed according to the configurations of the contact arm switch 112 and the trigger switch 114.

The method of determining that the control signal (ignition signal) was outputted from the control circuit in abnormal condition is not limited to the methods described in the above embodiments.

The method of preventing the control circuit (ignition circuit) from operating under an ignition signal when the ignition signal is abnormal is not limited to the methods described in the above embodiments.

The configurations of the trigger operation detecting circuit 260, the repeated signal detecting circuit 270 and the reset operation detecting circuit 280 are not limited to the configurations described in the above embodiments. Further, the method of detecting that the trigger is operated, the method of detecting that a repeated signal is outputted from the control circuit, and the method of detecting that the control circuit completed execution of the reset process are not limited to the methods described in the above embodiments.

Further, although the combustion driving power tool is described here, the technique described in this specification can also be applied to other driving power tools. Further, it can also be applied to other power tools. In this case, it is defined as a power tool.

DESCRIPTION OF NUMERALS

100 combustion driving power tool (driving power tool)
103 housing
105 handgrip
107 holder
108 battery
109 magazine
110 nail ejection part
111 contact arm
112 contact arm switch
113 trigger
114 trigger switch (operation signal output sircuit)
120 cylinder
121 piston
122 driver
123 cushion rubber
130 fan
131 motor
140 spark plug
140*a*, 140*b* electrode
141 gas cylinder
142 jet
143 combustion chamber
143*a* combustion chamber wall
144 exhaust port
200 control unit
210 control circuit (microcomputer)
220 regulator (voltage regulating circuit)
230 motor driving circuit
240 battery voltage detecting circuit
250 ignition circuit
260 trigger operation detecting circuit
270 repeated signal detecting circuit
280 reset operation detecting circuit

I claim:

1. A driving power tool comprising:
a movable element that moves a material to be driven in a driving direction;
a drive unit that drives the movable element;
an actuation circuit that actuates the drive unit;
a control circuit; and
an operation switch that outputs an operation signal for instructing driving of the movable element;
wherein:
the control circuit outputs a control signal when the operation signal for instructing driving of the movable element is outputted from the operation switch;
the actuation circuit actuates the drive unit when the control signal is outputted from the control circuit;
an actuation of the drive unit is blocked when the control circuit is in an abnormal condition and the control signal outputted from the control circuit is abnormal, the actuation of the drive unit being blocked when the abnormal control signal is prevented from being inputted into the actuation circuit; and
actuation of the drive unit is blocked when the control signal is outputted from the control circuit in the state in which the operation signal for instructing driving of the movable element is not outputted from the operation switch.

2. The driving power tool as defined in claim 1, further comprising a block circuit provided between the control circuit and the actuation circuit, wherein the block circuit blocks passage of the control signal when the control signal outputted from the control circuit is abnormal.

3. The driving power tool as defined in claim 1, whereby the actuation circuit actuates the drive unit only when both the control signal is outputted from the control circuit and operation signal is present.

4. The driving power tool as defined in claim 3, whereby the actuation circuit actuates the drive unit only when the control signal is present as a constant signal.

5. The driving power tool as defined in claim 1, further comprising a reset timing circuit which outputs a reset timing period complete signal after a predetermined reset timing period is complete such that the actuation circuit actuates the drive unit only when both the reset timing period complete signal and the control signal are present.

6. The driving power tool as defined in claim 5, whereby the actuation circuit actuates the drive unit only when the control signal is present as a constant signal.

7. The driving power tool as defined in claim 1, whereby the actuation circuit actuates the drive unit only when the control signal is present as a constant signal.

8. A driving power tool comprising:
a movable element that moves a material to be driven in a driving direction;
a drive unit that drives the movable element;
an actuation circuit that actuates the drive unit;
a control circuit; and
an operation switch that outputs an operation signal for instructing driving of the movable element;
wherein:
the control circuit outputs a control signal when the operation signal for instructing driving of the movable element is outputted from the operation switch;
the actuation circuit actuates the drive unit when the control signal is outputted from the control circuit;
an actuation of the drive unit is blocked when the control circuit is in an abnormal condition and the control signal outputted from the control circuit is abnormal, the actuation of the drive unit being blocked when the abnormal control signal is prevented from being inputted into the actuation circuit; and
actuation of the drive unit is blocked when the control signal is outputted from the control circuit within a specified time period after the control circuit completes execution of a reset process.

9. A driving power tool comprising:
a movable element that moves a material to be driven in a driving direction;
a drive unit that drives the movable element;
an actuation circuit that actuates the drive unit;
a control circuit; and
an operation switch that outputs an operation signal for instructing driving of the movable element;
wherein:
the control circuit outputs a control signal when the operation signal for instructing driving of the movable element is outputted from the operation switch;
the actuation circuit actuates the drive unit when the control signal is outputted from the control circuit;
the control circuit outputs a repeated signal of a specified frequency, and actuation of the drive unit is blocked when the control signal is outputted from the control circuit in the state in which the repeated signal of the specified frequency is not outputted from the control circuit; and an actuation of the drive unit is blocked when the control circuit is in an abnormal condition and the control signal outputted from the control circuit is abnormal, the actuation of the drive unit being blocked when the abnormal control signal is prevented from being inputted into the actuation circuit.

10. A driving power tool comprising:

a movable element that moves a material to be driven in a driving direction;

a drive unit that drives the movable element;

an actuation circuit that actuates the drive unit;

a control circuit;

an operation switch that outputs an operation signal for instructing driving of the movable element;

wherein:

the control circuit outputs a control signal when the operation signal for instructing driving of the movable element is outputted from the operation switch;

the actuation circuit actuates the drive unit when the control signal is outputted from the control circuit;

an actuation of the drive unit is blocked when the control circuit is in an abnormal condition and the control signal outputted from the control circuit is abnormal, the actuation of the drive unit being blocked when the abnormal control signal is prevented from being inputted into the actuation circuit; and a reset timing circuit which outputs a reset timing period complete signal after a predetermined reset timing period is complete such that the actuation circuit actuates the drive unit only when both the reset timing period complete signal and the control signal are present.

11. The driving power tool as defined in claim 10, whereby the actuation circuit actuates the drive unit only when the control signal is present as a constant signal.

* * * * *